US008284631B2

(12) United States Patent
Cho et al.

(10) Patent No.: US 8,284,631 B2
(45) Date of Patent: Oct. 9, 2012

(54) MULTIMEDIA PROJECTION ALARM CLOCK WITH INTEGRATED ILLUMINATION

(75) Inventors: Kuo-Hsiung Cho, Zhubei (TW); Ping-Hung Tsai, Hsinchu (TW); Chin-I Liu, Houli Shiang (TW)

(73) Assignee: Tirid Tech Co., Ltd., Sheung Shui, New Territories (HK)

( * ) Notice: Subject to any disclaimer, the term of this patent is extended or adjusted under 35 U.S.C. 154(b) by 485 days.

(21) Appl. No.: 12/637,267

(22) Filed: Dec. 14, 2009

(65) Prior Publication Data

US 2011/0141856 A1 Jun. 16, 2011

(51) Int. Cl.

| | |
|---|---|
| ***G04B 47/00*** | (2006.01) |
| ***G04B 21/00*** | (2006.01) |
| ***G04C 19/00*** | (2006.01) |
| ***G04C 21/16*** | (2006.01) |

(52) U.S. Cl. ..... 368/10; 368/73; 368/79; 368/256

(58) Field of Classification Search ..... 368/10, 368/12, 72–74, 79, 250, 256

See application file for complete search history.

(56) References Cited

U.S. PATENT DOCUMENTS

| | | | | |
|---|---|---|---|---|
| 3,136,210 | A * | 6/1964 | Barrett | 368/79 |
| 4,285,028 | A * | 8/1981 | Sundin et al. | 362/35 |
| 4,497,582 | A * | 2/1985 | Lipman et al. | 368/15 |
| 5,243,568 | A * | 9/1993 | Burch et al. | 368/73 |
| 5,247,492 | A * | 9/1993 | Pan | 368/79 |
| 5,260,919 | A * | 11/1993 | Tsai | 368/223 |
| 5,559,762 | A * | 9/1996 | Sakamoto | 368/74 |
| 5,590,944 | A * | 1/1997 | Stokes | 353/122 |
| 5,649,827 | A * | 7/1997 | Suzaki | 434/284 |
| 6,236,622 | B1 * | 5/2001 | Blackman | 368/10 |
| 6,795,377 | B2 * | 9/2004 | Gorden | 368/12 |
| 6,798,720 | B2 * | 9/2004 | Haupt et al. | 368/79 |
| 7,149,152 | B1 * | 12/2006 | Chan | 368/79 |
| 7,266,049 | B1 * | 9/2007 | Suber, et al. | 368/12 |
| 7,379,393 | B2 * | 5/2008 | Morykwas et al. | 368/10 |
| 7,457,204 | B1 * | 11/2008 | Winters | 368/73 |
| 7,685,238 | B2 * | 3/2010 | Etelapera | 709/205 |
| 7,755,976 | B2 * | 7/2010 | Lin et al. | 368/109 |
| 7,798,144 | B2 * | 9/2010 | Kwok et al. | 128/204.18 |
| 2001/0046852 | A1 * | 11/2001 | Dorr | 455/413 |
| 2002/0105620 | A1 * | 8/2002 | Goulden et al. | 353/30 |
| 2003/0206494 | A1 * | 11/2003 | Haupt et al. | 368/79 |
| 2005/0169110 | A1 * | 8/2005 | Mazzilli et al. | 368/73 |
| 2006/0190267 | A1 * | 8/2006 | Chan | 704/275 |
| 2007/0057775 | A1 * | 3/2007 | O'Reilly et al. | 340/309 |
| 2008/0112271 | A1 * | 5/2008 | Chan | 368/30 |
| 2009/0073812 | A1 * | 3/2009 | Hsu | 368/10 |
| 2009/0251585 | A1 * | 10/2009 | Joseph | 348/333.01 |
| 2010/0022220 | A1 * | 1/2010 | Gupta et al. | 455/412.2 |
| 2011/0193934 | A1 * | 8/2011 | Roberts et al. | 348/14.08 |

* cited by examiner

*Primary Examiner* — Vit W Miska

(74) *Attorney, Agent, or Firm* — Muncy, Geissler, Olds & Lowe, PLLC

(57) ABSTRACT

A multimedia projection alarm clock with integrated illumination is disclosed. It includes a projector module which projects an animated image, an illuminating light source which emits illuminating light of adjustable color and/or brightness, a speaker which outputs music or sound effects, and a control unit which animates a projected image and/or varies an illuminating light with music or sound effects so that an alarm signal featuring a theme of vivid figures with matching backgrounds may be provided. The control unit is also equipped with a simple user interface allowing the user to access handy bedside functions such as the night light easily.

20 Claims, 3 Drawing Sheets

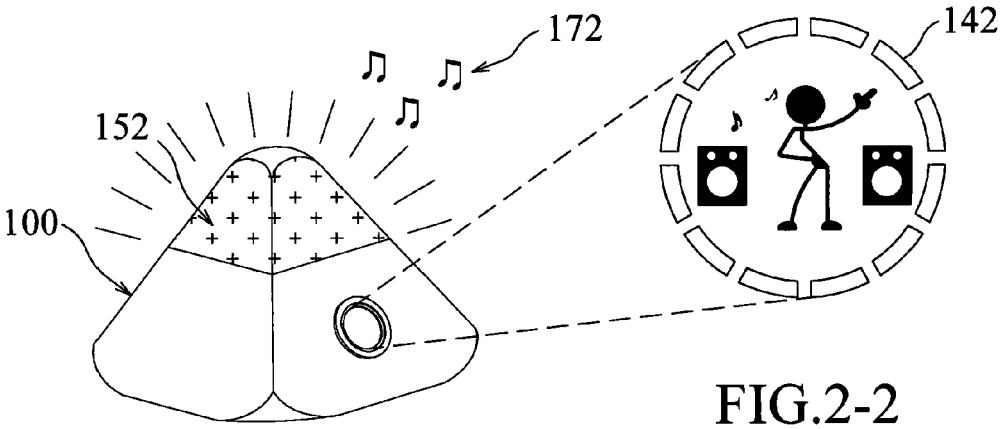
FIG.2-2
FIG.2-1
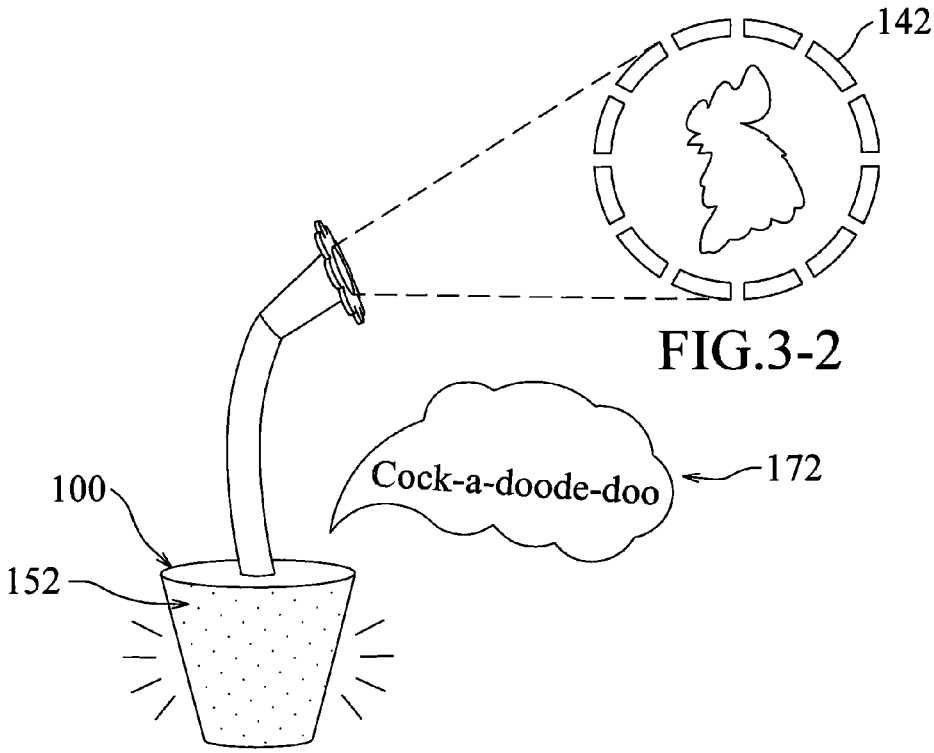
FIG.3-2
FIG.3-1

MULTIMEDIA PROJECTION ALARM CLOCK WITH INTEGRATED ILLUMINATION

BACKGROUND OF THE INVENTION

1. Field of the Invention

The present invention is related to a projection alarm clock, and more particularly to a multimedia projection alarm clock with integrated illumination.

2. Description of the Prior Art

In general, a projection clock projects a clock image, dial or digital, on a surface such as a ceiling or a wall. Since the clock image, usually enlarged, can be viewed in the dark, a projection clock serves as a convenient bedside companion.

Conventionally, a projection clock projects an image of an actual mechanical dial clock or a digital clock constructed with 7-segment displays. In order to serve the purpose to be a bedside companion, a projection clock usually includes an alarm feature, which is appealing to be delightful and entertaining. However, conventional mechanisms for creating clock images do not allow much variation to be introduced to the alarm feature of the projection clock.

Besides a projection clock, a night light is usually required for bedside. Conventionally, the projection clock and night light are separate entities and as a result, a user usually has to identify the two in the dark.

Therefore, it is highly desirable to provide a multimedia projection alarm clock with integrated illumination as an ultimate bedside companion that uses a simple user interface for all the handy functions and provides a dynamically entertaining alarm feature.

SUMMARY OF THE INVENTION

The present invention is directed to a multimedia projection alarm clock with integrated illumination which animates a projected image and/or varies an illuminating light with music or sound effects so that an alarm signal presenting a theme of vivid figures with matching backgrounds may be provided.

The present invention also provides a multimedia projection alarm clock with integrated illumination that allows a user to access several handy bedside functions such as the projection clock, alarm clock, and night light through a simple user interface.

According to an embodiment, the proposed multimedia projection alarm clock with integrated illumination includes a projector module, an illuminating light source, a speaker, a control unit, a user interface and a power supply. The projector module is used for projecting an animated image and information on a surface. The illuminating light source is used for emitting an illuminating light with adjustable brightness and/or color. The illuminating light source can be but not limited to including at least a white LED and/or at least one of each RGB LEDs. The speaker is used for outputting music or sound effects. The control unit is electrically connected with the projector module, the illuminating light source, and the speaker, so as to generate an alarm signal including the animated image, the music or sound effects, the illuminating light or combinations thereof when reaching a preset alarm time. The user interface is for a user to operate the multimedia projection alarm clock with integrated illumination. The power supply module supplies the needed power to operate the multimedia projection alarm clock with integrated illumination.

The control unit controls the animated image, the music or sound effects, and the illuminating light in an independent manner or in a coordinated manner, so that handy bedside functions may be provided separately, and a multimedia alarm signal may be provided.

According to an embodiment, the user interface includes a key set, disposed on the housing or a remote control of the multimedia projection alarm clock with integrated illumination, for adjusting the settings and disabling the alarm signal. The user interface, according to an embodiment may also allow the user to turn on/off the projector module, the speaker and the illuminating light source separately or as a group, and/or allow the user to select the animated image, the music or sound effects and the illuminating light separately or as a group.

BRIEF DESCRIPTION OF THE DRAWINGS

The foregoing conceptions and their accompanying advantages of this invention will become more readily appreciated after being better understood by referring to the following detailed description, in conjunction with the accompanying drawings, wherein:

FIG. 2-1 and FIG. 2-2 are schematic diagrams illustrating the alarm signal of the multimedia projection alarm clock with integrated illumination according an embodiment of the present invention;

FIG. 3-1 and FIG. 3-2 are schematic diagrams illustrating the alarm signal of the multimedia projection alarm clock with integrated illumination according another embodiment of the present invention.

DESCRIPTION OF THE PREFERRED EMBODIMENT

The detailed explanation of the present invention is described as follows. The described preferred embodiments are presented for purposes of illustrations and description, and they are not intended to limit the scope of the present invention.

Figure 1:
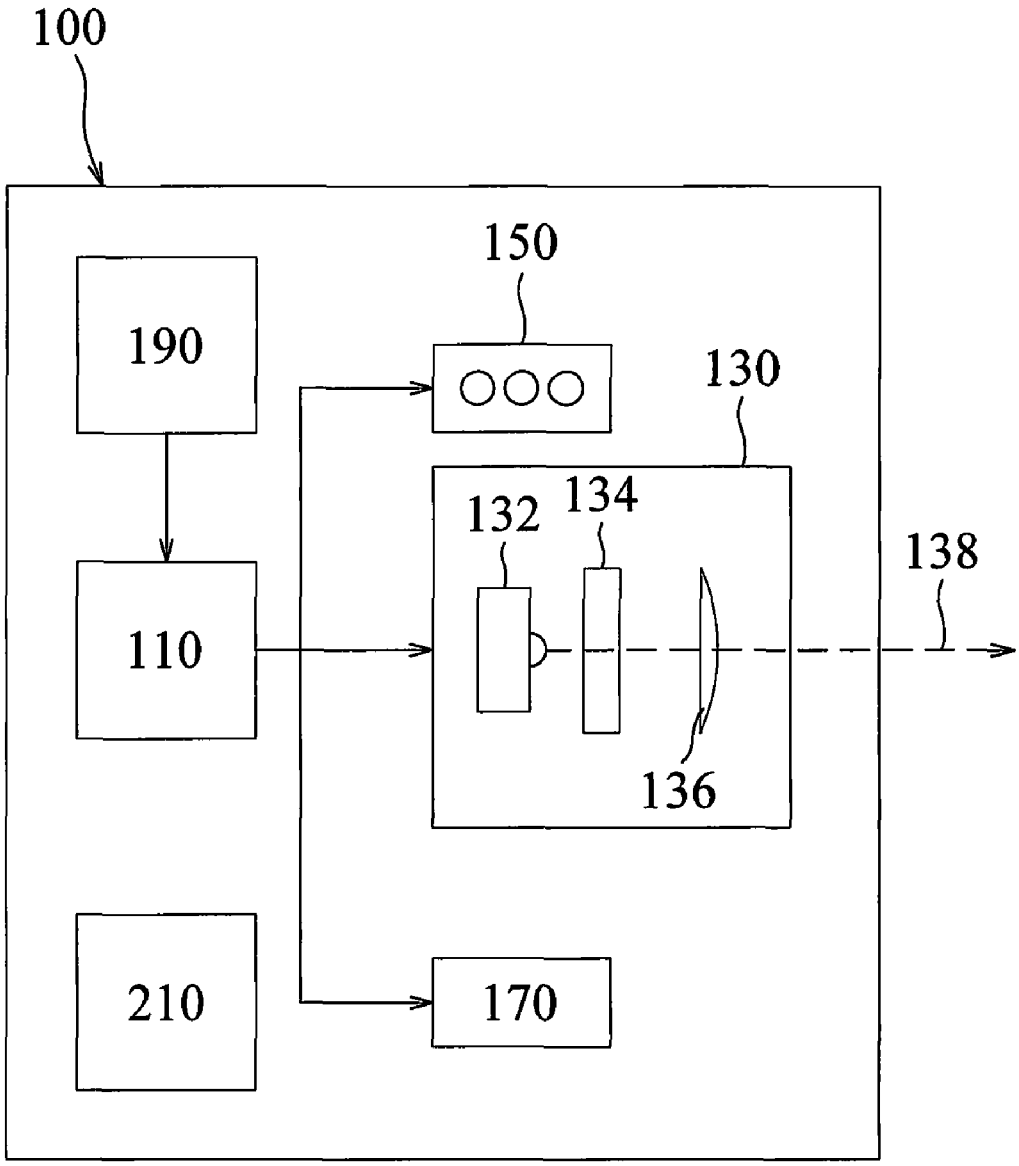
FIG. 1 is a block diagram illustrating the multimedia projection alarm clock with integrated illumination according to an embodiment of the present invention.

FIG. 1 is a block diagram illustrating the multimedia projection alarm clock with integrated illumination 100 according to an embodiment of the present invention. As shown in FIG. 1, the multimedia projection alarm clock with integrated illumination 100 includes: a projector module 130 for projecting an animated image and an information on a surface; an illuminating light source 150 for emitting an illuminating light with adjustable color and/or brightness; a speaker 170 for outputting music or sound effects; a control unit 110 electrically connected with the projector module 130, the illuminating light source 150 and the speaker 170 so as to generate an alarm signal comprising the animated image, the music or sound effects, the illuminating light or combinations thereof when reaching a preset alarm time; a user interface 190 for a user to operate the multimedia projection alarm clock with integrated illumination 100; and a power supply module 210 for supplying power needed for the operations of the multimedia projection alarm clock with integrated illumination 100.

In the above-mentioned embodiment, the projector module 130 is controlled by the control unit 110, which may be a microprocessor control unit (MCU), so that it is possible to project an animated image such as a moving figure or object as the alarm signal. Not only so, the control unit 110 may also play music or sound effects with the animated image so that a vivid figure such as a vocalizing animal or a noisy vehicle such as an approaching UFO may be created. Besides, since the multimedia projection alarm clock with integrated illumination 100 of the above-mentioned embodiment is equipped with the illuminating light source 150 that is also under the control of the control unit 110, light effects may be added. A theme of the alarm signal may, therefore, be composed with the coordinated animated image, music or sound effects and illuminating light.

FIG. 2-1 and FIG. 2-2 are schematic diagrams illustrating the alarm signal of the multimedia projection alarm clock with integrated illumination according to an embodiment. In this embodiment, a theme of a person dancing happily with music is presented, wherein the alarm signal includes an animated image 142 of a dancing person who dances with the music 172 of brisk tempo, and the illuminating light 152 that varies the flashing frequency and/or color with the tempo of the music 172.

FIG. 3-1 and FIG. 3-2 are schematic diagrams illustrating the alarm signal of the multimedia projection alarm clock with integrated illumination 100 according to another embodiment. In this embodiment, a theme of a lively farm morning is presented, wherein the alarm signal includes an animated image 142 of a cock with a moving head and mouth, sound effects 172 of the cock-a-doodle-doo sound played when the cock raises its head and opens its mouth, and a white illuminating light 152 that lights up at least a portion of the room to signify the arrival of a bright day.

According to another embodiment, a theme of an approaching UFO that greets the user is presented, wherein the alarm signal starts with an illuminating light 152 that varies its color and intensity, and sound effects 172 of a high frequency and yet far away noise resembling that emitted by a far away UFO. When the user is awoke and disable the alarm signal, the animated image 142 shows an approaching UFO (a gradually enlarging object), and sound effects 172 mimicking the Doppler effect of an approaching UFO. When the animated image 142 stops moving, a greeting sound effect 172 saying, for example, "Good Morning!" may be played.

According to an embodiment, the control unit also controls the animated image 142, the music or sound effects 172 and the illuminating light 152 independently so that each function may be accessed separately, or as a group such as in the form of a bed mode, in which the illuminating light 152 changes its color slowly with the music 172 to provide a soothing effect for the user before bed.

In the following, embodiments with further details of the components or additional features of the multimedia projection alarm clock with integrated illumination are disclosed.

Referring to FIG. 1, the projector module 130, according to an embodiment, comprises a transmissive type image panel 134 for displaying the animated image and the information; a projecting light source 132 configured on one side of the image panel 134 so as to emit a projecting light 138 to pass through the image panel 134 to produce a projected image on a surface such as a wall; and a set of projecting lenses 136 configured on the optical path of the projected image on the other side of the image panel 134 so as to focus or adjust the size of the projected image.

According to another embodiment, the projector module comprises a reflective type image panel for displaying the animated image and the information; a projecting light source emitting a projecting light to be reflected by the image panel to produce a projected image on a surface such as a wall; and a set of projecting lenses configured on the optical path of the projected image so as to focus or adjust the size of the projected image. The configuration of the above embodiments for the projector module may be modified with additional optical elements such as prisms or mirrors as one skilled in the art may understand.

The image panel, as indicated above, may be transmissive type or reflective type. The transmissive type image panel can be but not limited to a liquid crystal display (LCD) panel. The reflective type image panel can be but not limited to a Liquid Crystal on Silicon (LCoS) panel. In the figures, the transmissive type image panel is selected as the example to illustrate the major components of the projector module and is referred to as the image panel herein.

Referring to FIG. 1, the pattern that the image panel 134 displays may include information such as time, week, date, and so on, and an animated image as described above. The resolution of the image panel 134 should be sufficient to differentiate numbers and portray the shape of figures or objects, e.g. around 96×64 dots. The size of the image panel 134, according to one embodiment, can be fairly small, e.g. around 1 inch; as a result, it is possible to pack the projector module into a compact shape such as the pyramid in FIG. 2-1, and the flower bud in FIG. 3-1, an advantage which the prior art projection clocks are unlikely to have, since an actual mechanical clock or digital clock are required to be positioned. According to different embodiments, the angle at which the projector module 130 projects the image may be fixed as shown in FIG. 2-1, or variable as shown in FIG. 3-1, where the stem of the flower is bendable.

Referring to FIG. 1, the projecting light source 132 is strong enough to project the patterns on the image panel 134 onto the wall clearly. Also, the image not only may be viewed in the dark like during the night time, but also may be seen with light such as in the day time. According to different embodiments, the projecting light source can be but not limited to including high power white light emitting diodes (LED), halogen light bulbs, HID (High Intensity Discharge) light bulbs or UHP (Ultra High Performance) light bulbs or the combinations thereof.

Referring to FIG. 1, the illuminating light source 150, according to one embodiment, can be but not limited to including red, green and blue light emitting diodes (RGB LEDs) and/or white LEDs, so that the illuminating light 152 of adjustable color and/or brightness may be provided.

Referring to FIG. 1, the user interface 190 is connected with the control unit 110, allowing the user to set the settings such as time, week, date, alarm time, alarm signal etc., and to disable the alarm signal. The user interface 190 may also allow the user to, separately or as a group, turn on/off the projector module 130, the speaker 170 and the illuminating light source 150, and/or select the animated image 142, the music or sound effects 172, the color or brightness of the illuminating light 152.

The user interface 190, according to an embodiment, includes a key set on the housing of the multimedia projection alarm clock with integrated illumination 100. The key set may be touch-sensing, such as a capacitive touch-sensing key set. According to an embodiment, the user interface may also include, on the housing of the multimedia projection alarm clock with integrated illumination 100 such as at the top of the flower pot in FIG. 3-1, a touch-sensing switch, e.g. a capacitive touch-sensing switch, for the illuminating light source 150, so that the multimedia projection alarm clock with integrated illumination 100 may also be used as a night light or lamp. The clock image may also be projected together if desired, and the alarm signal may be disabled in the same manner, i.e. by slightly tapping the surface at the top of the flower pot shown in FIG. 3-1.

Figure 4:
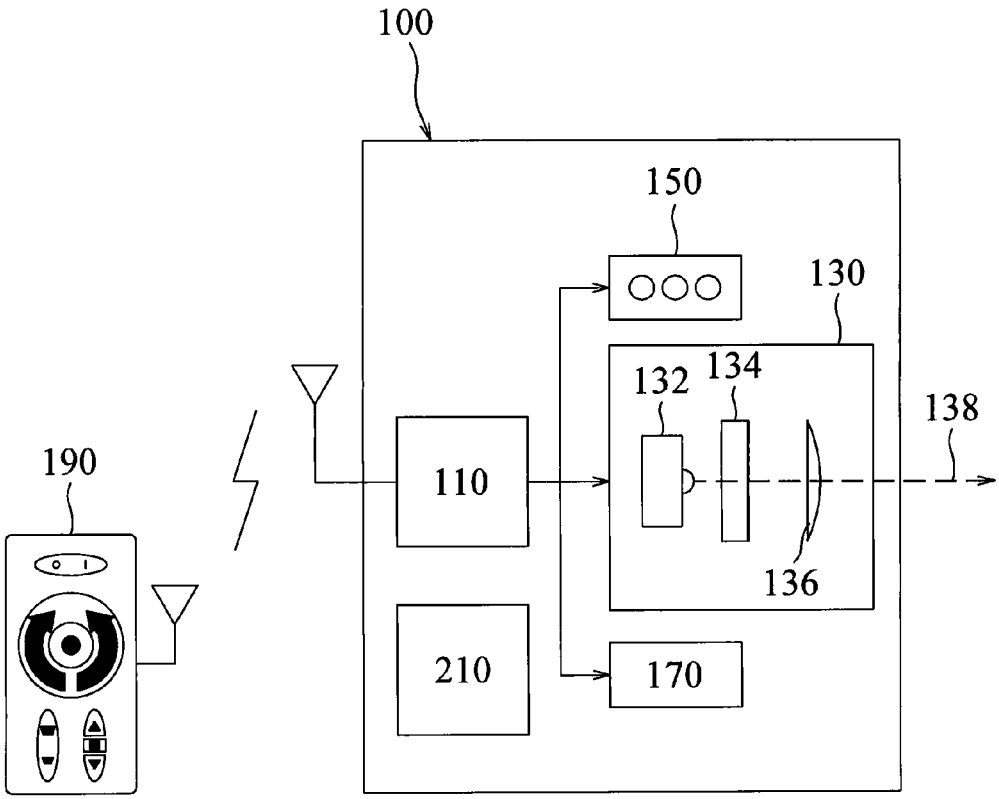
FIG. 4 is a block diagram illustrating the multimedia projection alarm clock with integrated illumination with another embodiment of the user interface.

FIG. 4 is a block diagram illustrating the multimedia projection alarm clock with integrated illumination 100 with another embodiment of the user interface 190. The user interface 190 here includes a remote control on which a key set is disposed. The key set may be touch-sensing. With the remote control, the size of the multimedia projection alarm clock can be more compact, and the user does not have to turn back and forth between the multimedia projection alarm clock with integrated illumination 100 and the projected image to adjust the settings.

The power supply module 210 supplies power needed for the operation of the multimedia projection alarm clock with integrated illumination 100. According to different embodiments, the power supply module 210 may be a battery module, preferably rechargeable, or an external power supply such as an adaptor that converts household line voltage into a suitable DC voltage.

Additionally, according to an embodiment, the multimedia projection alarm clock with integrated illumination 100 further includes a temperature sensor and/or a humidity sensor electrically connected with the control unit 110 so as to detect the temperature and/or the humidity of the environment. Therefore, the information projected by the projector module 130 may also include temperature and/or humidity. According to another embodiment, the temperature and the humidity sensors may be installed outside the house and are equipped with a wireless transmitter to send the detected data to the wireless receiver configured in the multimedia projection alarm clock with integrated illumination 100.

To summarize the foregoing descriptions, the multimedia projection alarm clock with integrated illumination of the present invention includes a control unit, preferably with a remote control and touch-sensing user interface, controlling a projector module, an illuminating light source and a speaker in coordination or independently so that the animated image, the music or sound effects and the illuminating light may be combined to form the alarm signal, or may individually provide handy bedside functions such as a projection clock, and a night light. In particular, a theme with vivid figures and matching backgrounds may be presented as the alarm signal, allowing the awakening experience, for example, to be dynamically entertaining.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. An multimedia projection alarm clock with integrated illumination comprising:

a projector module for projecting an animated image and information on a surface;

an illuminating light source for emitting an illuminating light with adjustable color and/or brightness;

a speaker for outputting a music or sound effects;

a control unit electrically connected with the projector module, the illuminating light source and the speaker so as to generate an alarm signal comprising the animated image, the music or sound effects, the illuminating light or combinations thereof, when reaching a preset alarm time;

a user interface for a user to operate the multimedia projection alarm clock with integrated illumination; and a power supply module for supplying power needed for the operations of the multimedia projection alarm clock with integrated illumination.

2. The multimedia projection alarm clock with integrated illumination according to claim 1, wherein the control unit controls the animated image, the music or sound effects and the illuminating light independently or in coordination.

3. The multimedia projection alarm clock with integrated illumination according to claim 1 further comprising a temperature and/or humidity sensor electrically connected with the control unit so as to detect the temperature and/or the humidity of the environment.

4. The multimedia projection alarm clock with integrated illumination according to claim 3, wherein the information comprises the current time, the alarm time, the date, the temperature, the humidity or combinations thereof.

5. The multimedia projection alarm clock with integrated illumination according to claim 1, wherein the user interface comprises a touch-sensing switch electrically connected with the control unit in order for the user to turn on/off the projector module and/or the illuminating light source.

6. The multimedia projection alarm clock with integrated illumination according to claim 5, wherein the touch-sensing switch comprises a capacitive touch-sensing switch.

7. The multimedia projection alarm clock with integrated illumination according to claim 1, wherein the user interface comprises a key set, disposed on the housing or a remote control of the multimedia projection alarm clock with integrated illumination for adjusting the settings, and disabling the alarm signal.

8. The multimedia projection alarm clock with integrated illumination according to claim 7, wherein the key set can also turn on/off the projector module, the speaker and the illuminating light source separately or as a group, and/or select the animated image, the music or sound effects and the illuminating light separately or as a group.

9. The multimedia projection alarm clock with integrated illumination according to claim 7, wherein the key set comprises at least a touch-sensing key or switch.

10. The multimedia projection alarm clock with integrated illumination according to claim 9, wherein the touch-sensing key or switch is a capacitive touch-sensing key or switch.

11. The multimedia projection alarm clock with integrated illumination according to claim 1, wherein the projector module comprises:

a transmissive type image panel for displaying the animated image and the information;

a projecting light source configured on one side of the image panel so as to emit a projecting light to pass through the image panel whereby a projected image is produced; and a set of projecting lenses configured on the optical path of the projected image on the other side of the image panel for focusing and/or adjusting the size of the projected image.

12. The multimedia projection alarm clock with integrated illumination according to claim 11, wherein the transmissive type image panel comprises a liquid crystal display (LCD) panel.

13. The multimedia projection alarm clock with integrated illumination according to claim 11, wherein the projecting light source comprises at least one of the following: LED (light emitting diode), halogen light bulb, HID (High Intensity Discharge) light bulb, and UHP (Ultra High Performance) light bulb.

14. The multimedia projection alarm clock with integrated illumination according to claim 13, wherein the projecting light source comprises at least one white LED.

15. The multimedia projection alarm clock with integrated illumination according to claim 1, wherein the projector module comprises:

a reflective type image panel for displaying the animated image and the information;

a projecting light source emitting a projecting light to be reflected by the image panel whereby a projected image is produced; and a set of projecting lenses configured on the optical path of the projected image for focusing and/or adjusting the size of the projected image.

16. The multimedia projection alarm clock with integrated illumination according to claim 15, wherein the reflective type image panel comprises a Liquid Crystal on Silicon (LCoS) panel.

17. The multimedia projection alarm clock with integrated illumination according to claim 15, wherein the projecting light source comprises at least one of the following: LED (light emitting diode), halogen light bulb, HID (High Intensity Discharge) light bulb, and UHP (Ultra High Performance) light bulb.

18. The multimedia projection alarm clock with integrated illumination according to claim 17, wherein the projecting light source comprises at least one white LED.

19. The multimedia projection alarm clock with integrated illumination according to claim 1, wherein the illuminating light source comprises at least one red LED (light emitting diode), one green LED and one blue LED and/or one white LED.

20. The multimedia projection alarm clock with integrated illumination according to claim 1, wherein the power supply comprises an external power supply and/or a battery module.

* * * * *